US007735783B2

(12) United States Patent
Haney et al.

(10) Patent No.: US 7,735,783 B2
(45) Date of Patent: Jun. 15, 2010

(54) LOCK EXTENSION FOR TRAIN DERAIL

(75) Inventors: Christopher Haney, Chicago, IL (US); Jaime Carr, Regina (CA); James Reid, Regina (CA)

(73) Assignee: General Electric Railcar Services Corporation, Chicago, IL (US)

( * ) Notice: Subject to any disclaimer, the term of this patent is extended or adjusted under 35 U.S.C. 154(b) by 0 days.

(21) Appl. No.: 12/082,799

(22) Filed: Apr. 14, 2008

(65) Prior Publication Data

US 2009/0256030 A1 Oct. 15, 2009

(51) Int. Cl.
*B61L 19/02* (2006.01)

(52) U.S. Cl. ..... 246/163; 104/262

(58) Field of Classification Search ..... 246/163; 104/262, 263, 264, 272, 273, 274
See application file for complete search history.

(56) References Cited

U.S. PATENT DOCUMENTS

| | | | | | |
|---|---|---|---|---|---|
| 817,518 | A * | 4/1906 | Roach | ..... | 246/163 |
| 1,106,155 | A * | 8/1914 | Newkirk | ..... | 246/163 |
| 1,130,433 | A * | 3/1915 | Richter | ..... | 246/163 |
| 1,190,029 | A * | 7/1916 | Smyth | ..... | 246/163 |
| 1,287,214 | A * | 12/1918 | Buell | ..... | 246/163 |
| 1,346,009 | A * | 7/1920 | Estes | ..... | 246/163 |
| 1,420,425 | A | 6/1922 | Hayes | | |
| 1,420,426 | A | 6/1922 | Hayes | | |
| 1,439,371 | A * | 12/1922 | Leedy | ..... | 246/374 |
| 1,627,092 | A * | 5/1927 | Hayes | ..... | 246/163 |
| 2,138,504 | A * | 11/1938 | Overmier et al. | ..... | 246/163 |
| 2,330,780 | A * | 9/1943 | Klein | ..... | 246/115 |
| 3,517,186 | A * | 6/1970 | Hayes | ..... | 246/163 |
| 4,165,060 | A * | 8/1979 | Meyer | ..... | 246/163 |
| 6,105,906 | A * | 8/2000 | Pease et al. | ..... | 246/163 |
| 2002/0020349 | A1 * | 2/2002 | Woodnorth et al. | ..... | 118/500 |
| 2005/0151035 | A1 * | 7/2005 | Crain et al. | ..... | 248/163.1 |

* cited by examiner

*Primary Examiner*—S. Joseph Morano
*Assistant Examiner*—Jason C Smith

(57) ABSTRACT

The present disclosure relates generally to an improved safety device for use in the railroad industry. Specifically, the present disclosure relates to an above ground lock extension for train derails. Train derails are used in the railroad industry for derailing and therefore effectively stopping trains or unattended rolling stocks which rolls over said derail. The lock extension device comprises a locking device allowing an individual to lock said lock extension device to a derail while standing in an upright position, thereby diminishing injuries that may occur with prior art locking devices that are at ground level.

20 Claims, 5 Drawing Sheets

LOCK EXTENSION FOR TRAIN DERAIL

FIELD OF THE DISCLOSURE

The present disclosure relates to an improved safety device for railroads, and more specifically, to an above ground lock extension for a train derail.

BACKGROUND OF THE DISCLOSURE

Train derails are safety devices widely used in the railroad industry. A train derail is a device for derailing and therefore effectively stopping trains or unattended rolling stock (a railroad vehicle that is not a locomotive; a railroad car) which runs into the derail. The train derail works by derailing the train or rolling stock as it rolls over or through the derail.

Train derails may be utilized at various locations of the railway network. These locations can be exemplified by (1) where sidings meet main lines or other tracks, (2) at junctions or other crossings to protect the interlocking against unauthorized movement, and (3) at areas wherein railroad personnel are working on a rail line.

Train derails come in different forms. The most common and therefore the most widely used forms are (1) the wedge-shaped piece of steel type, (2) the "spilt rail" type and (3) the portable derail type.

The wedge-shaped piece of steel type of derail fits over the top of the rail. If a locomotive or rolling stock attempts to roll over it, the wheel flange is lifted over the rail to the outside thus derailing it. When the derail is not in use it can be folded away leaving the rail unobstructed. It can be manually operated via a locking device to prevent unauthorized removal of the derail from the rail.

The "split rail" type of derail is a complete or partial railroad switch which directs the "runaway" locomotive or rolling stock away from the main rail line.

The portable derail type is used as the name suggests, in situations where temporary protection is required due to men working or the presence of work equipment.

Train derails both of the permanent or portable type are provided in various sizes and weight to accommodate different sizes of rail.

Train derails whether permanent or portable can be used in conjunction with visible signaling devices such as a flag, which are usually blue in color. A flag is a signal used on a railroad track, usually to protect railroad workers or equipment on or about the track and serves as a warning that the track must not be entered and that equipment on or about the track must not be coupled to or moved. A flag signal is usually displayed above and between or beside the track rail. Since safety is a major concern of the rail industry signaling devices such as flags are usually used in conjunction with a derail so that their conjoint use provides a ultimate level of safety.

Train derails whether permanent or portable and whether used in conjunction with a signaling device or not are known in the art.

The state of the art in portable derails are known from U.S. Pat. No. 6,105,906, U.S. Pat. No. 1,130,433 and U.S. Pat. No. 1,106,155. U.S. Pat. No. 6,105,906 describes lightweight and ultra lightweight portable derails that can be installed and locked on a rail for protection of a certain location. U.S. Pat. No. 1,130,433 describes a portable derail which can be easily mounted or removed from the rail and one which is used in conjunction with a signaling device. U.S. Pat. No. 1,106,155 describes a portable derail which can be easily transported, adapted to be connected to a rail at any desired point.

The state of the art in permanent derail are known from U.S. Pat. No. 3,517,186, U.S. Pat. No. 1,287,214. U.S. Pat. No. 1,420,425 and U.S. Pat. No. 1,190,029. These patents describe various types of permanent derails as well as the use of a signaling device in conjunction with the derail.

Derails, whether permanent or portable, need to be locked in place in order to prevent their unauthorized removal from the rail. While the prior art has describes various improvements in the construction and design of derails, the locking device or mechanism has remained unchanged. The locking device or locking mechanism known in the prior art is positioned on the same plane as the derail itself. Therefore the prior art derail must be locked and unlocked by personnel in a prone, kneeling, bending, or squatting position. FIGS. 5, 6 and 7 illustrate Prior Art devices, and an individual having to lock the derails in a prone, kneeling, bending or squatting position.

The locking or unlocking of the derail's lock from a prone, squatting, kneeling or bending position can result in many medical problems for the personnel engaged in such activity. Additionally, the placement of the derail's lock at ground level makes the lock susceptible to the snow and ice which can result in frozen locks. Also, the frequent thawing of the frozen locks requires additional personnel and time which ultimately results in lost production time. Also, the placement of the lock at ground level usually requires that the person locking or unlocking the lock use both hands.

A need therefore exists for a locking device or locking mechanism which can be operated by personnel from a standing position.

SUMMARY OF THE DISCLOSURE

The present disclosure provides a lock extension device wherein said lock extension device can be mounted, affixed or inserted to a train derail and wherein said lock extension comprises 1) pole having a longitudinal member and a horizontal member and wherein said horizontal member of the pole can be inserted, affixed or mounted to the train derail, 2) a sleeve disposed over the pole, said sleeve comprising a cover on an end of said sleeve, said cover comprising an aperture for engaging said horizontal member of said pole, and 3) a locking device for holding said horizontal member in said aperture of said cover, said locking device further locking said pole to said sleeve.

It is an advantage of the present disclosure to provide a lock extension device which can be mounted, affixed or inserted to a train derail.

It is another advantage of the present disclosure to provide a lock extension device having a locking device for holding a lock.

It is a further advantage of the present disclosure to provide a lock extension device having a locking device wherein said locking device is positioned above the ground from the train derail.

It is a still further advantage of the present disclosure to provide a lock extension device having a locking device wherein said locking device can be operated by personnel in a standing position.

Moreover, it is another advantage of the present disclosure to provide a lock extension device having a locking device wherein said locking device is removed from environmental elements because it is located above the ground from the train derail.

Additional features and advantages of the present disclosure are described in, and will be apparent from, the detailed description of the embodiments and from the drawings.

DETAILED DESCRIPTION OF THE EMBODIMENTS

It will be understood by persons of ordinary skill in the art that the lock extension of the present disclosure may be mounted, affixed or inserted to a train derail of different forms including, but not limited to, the wedge-shaped piece of steel type, the split-rail type, and portable type. While only a lock extension which is inserted into a wedge-shaped type of derail will be described herein, and the accompanying drawings, it will be understood that the lock extension of the present disclosure may be applied to the different forms and/or types of derails as well as to derails of different sizes and weights.

Figure 1:
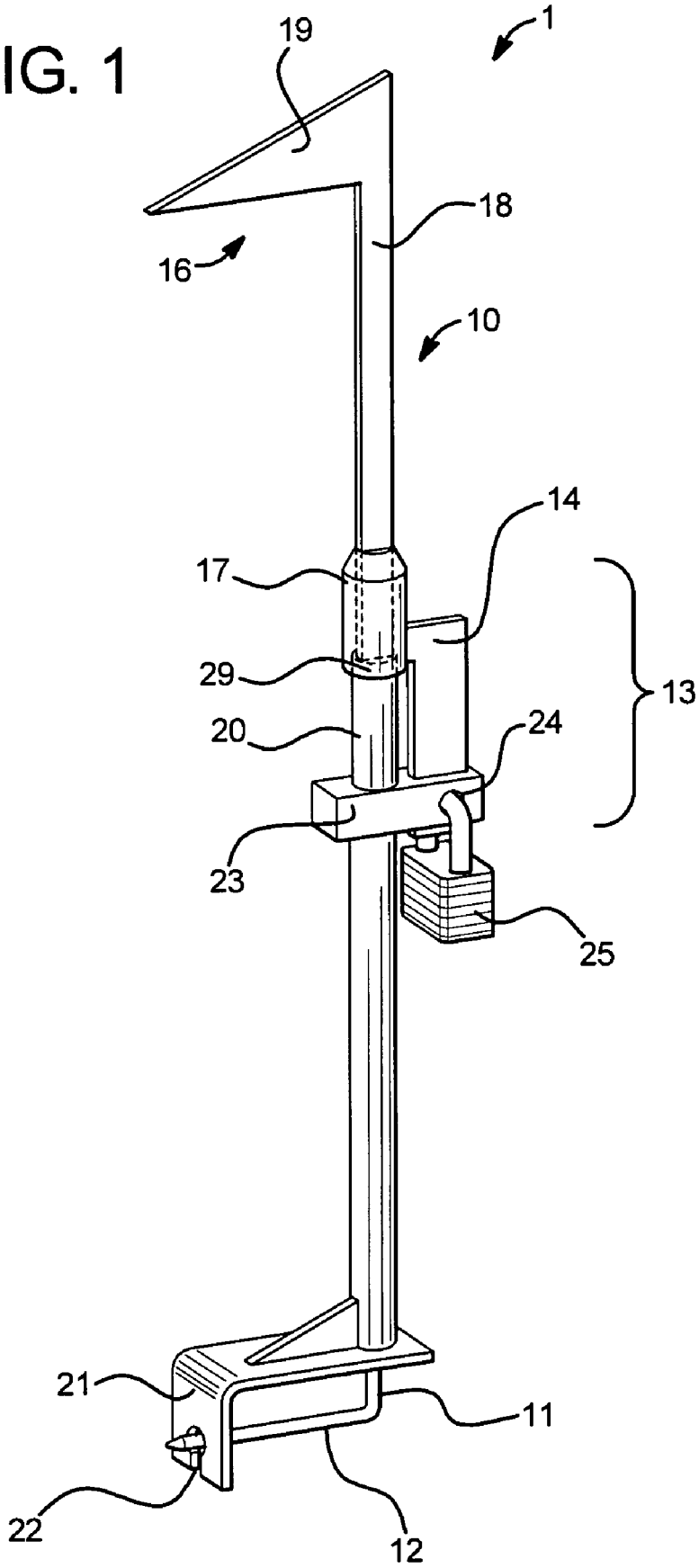
FIG. 1 is a perspective view of a lock extension device of the present invention that is locked in an embodiment of the present invention.

With reference now to the figures and in particular with reference to FIG. 1 showing a frontal view of a lock extension device 1 of the present disclosure. There is shown a pole 10 which is, preferably, cylindrical in shape having a longitudinal member 11 and a horizontal member 12 which is perpendicular to said longitudinal member 11. Pole 10 can be formed from metals, metal blends, woods or plastics. Metals or metal blends suitable for the practice of this disclosure can be exemplified by, but not limited to, copper, iron, aluminum, and steel. Woods can be exemplified by, but not limited to, any of the hard woods. Plastics can be exemplified, but not limited to, polycarbonates, polyvinyl chlorides, or others.

While the pole 10 has been described as having a longitudinal member 11 and a horizontal member 12, it is to be understood that in a preferred embodiments both members are formed integrally and simultaneously from the same material. It is also contemplated that the two portions of the pole may be formed independently and join together by means of welding or other assembly methods known in the art.

The longitudinal member 11 of the pole 10 may be any length useful for the present invention, but preferably from about 2 feet in length to about 6 feet in length. The length of the longitudinal member 11 of the pole 10 will depend on the desired height of the locking device (described below) to maintain operability of the locking device by an individual in an upright position. The horizontal member 12 of the pole will be shorter in length than the longitudinal member 11. The length of the horizontal member 12 should be sufficient to allow for complete insertion of the horizontal member 12 of the lock extension device 1 into a derail itself for locking said derail to a rail.

The pole 10 can be hollow or solid in construction. Since the longitudinal member 11 of the pole 10 is designed to accommodate a locking device and a signaling device (described below), this portion of the pole may have a circumference larger than the circumference of the horizontal member 12 of the pole 10. It will be understood that while the pole has been described as having a cylindrical shape, other shapes are also contemplated by this present disclosure.

Figure 3A:
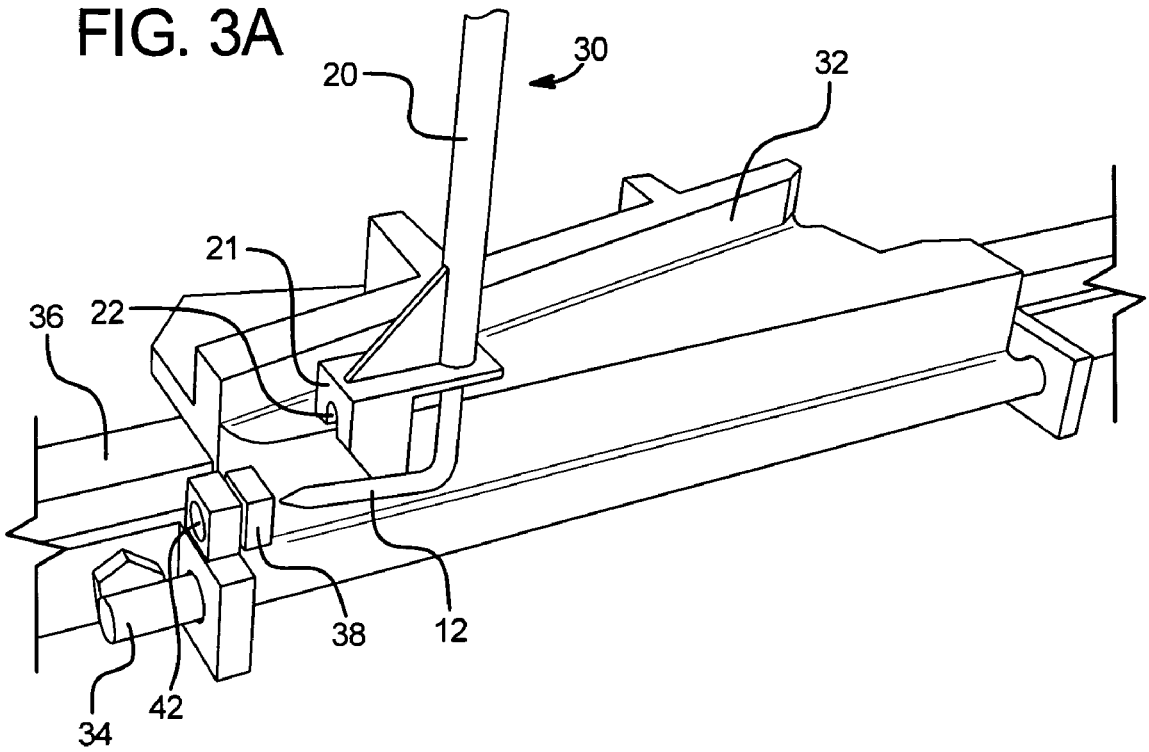
FIGS. 3A and 3B illustrate a preferred method of using said lock extension device with a derail in an embodiment of the present invention.
Figure 3B:
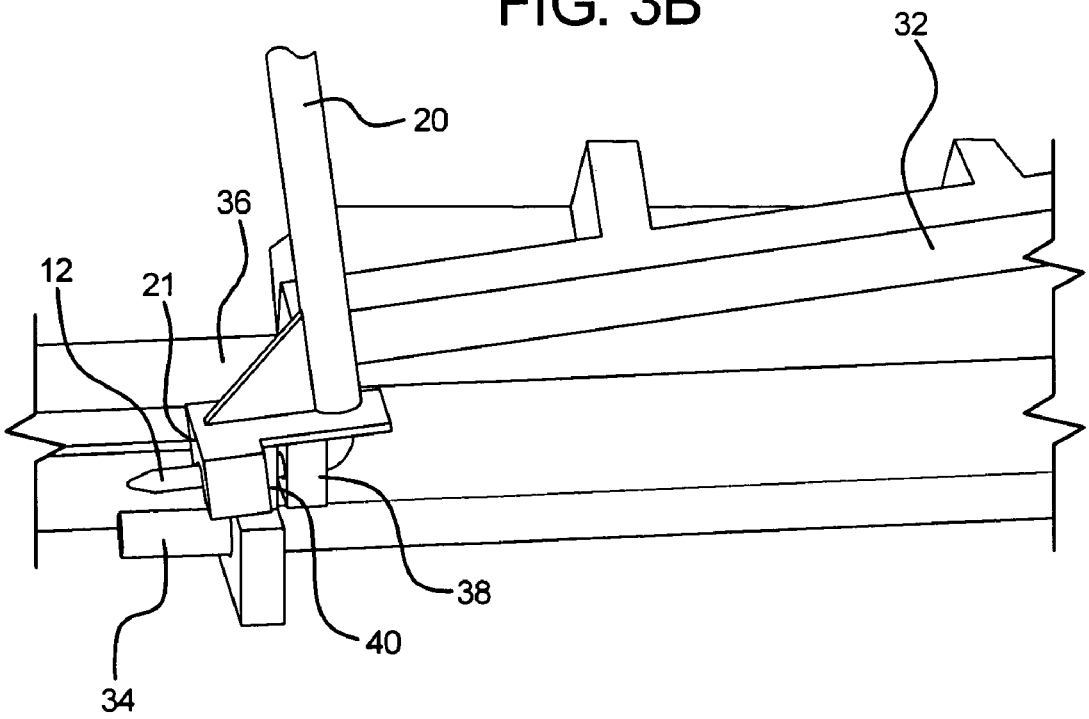

Still referring to FIG. 1, a locking device 13 is provided on the lock extension 1 for locking the horizontal member 12 to a derail, as illustrated in FIGS. 3A and 3B.

There is also provided a signaling device 16 which is placed over the top of the longitudinal member 11 of the pole 10. The signaling device 16 comprises a signal staff member 18 for holding a flag or other suitable signal 19. The signaling device 16, except for the flag or signal 19, is usually formed from the same material as the pole or from material that would be compatible with the material used to form the pole. The flag or signal 19 of the signaling device 16 is usually made from cloth or plastic and may be blue in color. The color of the flag, however, is preferably governed by the current railway safety code standards.

In a preferred embodiment, the signal staff member 18 is integrally formed with the pole 10 and, preferably, is an extension of the pole 10. As shown in FIG. 1, the pole 10 is disposed through a pole sleeve 20.

The pole sleeve 20 slidably extends over the pole 10 and terminates in a lock cover 21 having an aperture 22. The aperture 22 may be disposed over the horizontal member 12 when said pole sleeve 20 is disposed downwardly. The lock cover 21 allows the horizontal member 12 to be disposed within said aperture 22, thereby locking a derail to a rail, as illustrated below in FIGS. 3A and 3B.

Figure 2:
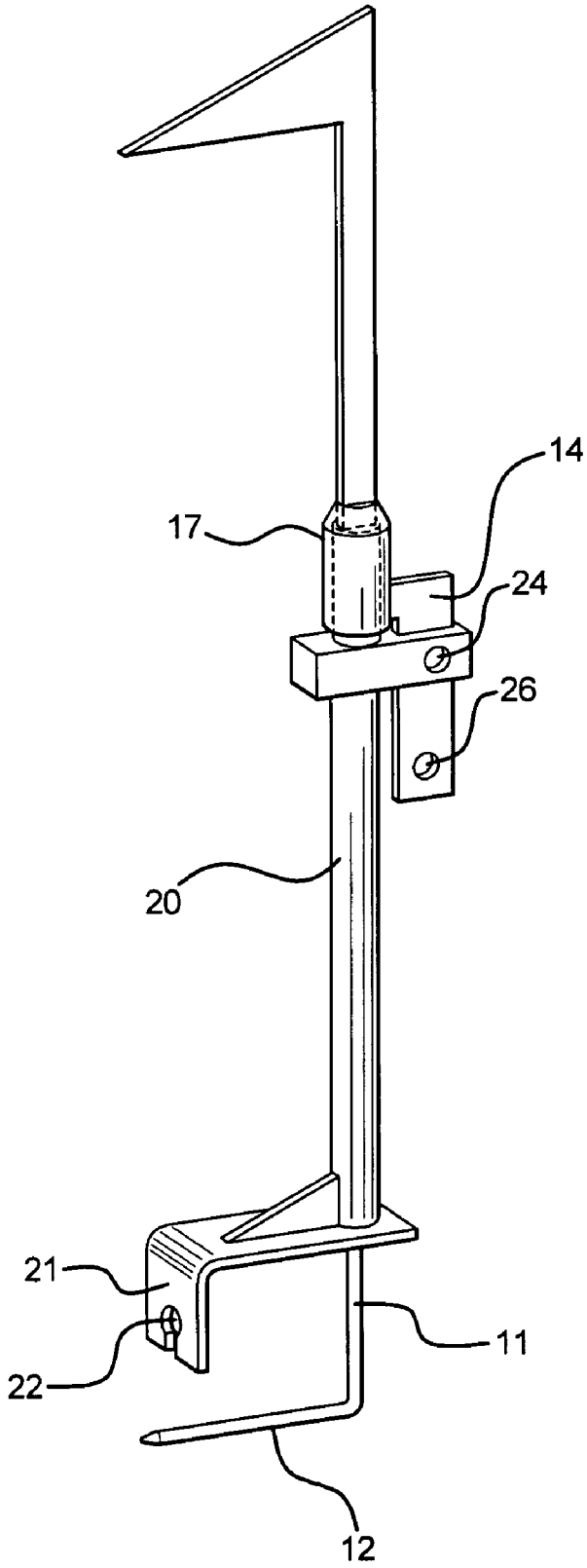
FIG. 2 is a perspective view of the lock extension device of the present invention that is unlocked and slidable in an alternate embodiment of the present invention.

Still referring to FIG. 1, the locking device 13 is now described. When disposed downwardly, flange 23, which is attached, adhered, welded or otherwise disposed to said pole sleeve 20 aligns with plate-like member 14, which is attached, adhered, welded or otherwise disposed to said pole 10. Preferably, flange 23 includes an aperture 24 that aligns with an aperture 26 (as shown in FIG. 2) in the plate-like member 14. A lock 25 may be disposed through aperture 24 in the flange 23 and the aperture 26 in the plate-like member 14 to lock said pole sleeve in place, thereby locking said lock cover 21 over said horizontal member 12 and, more specifically, locking said horizontal member 12 within aperture 22.

As with pole 10, said pole sleeve 20 and said lock cover 21 may be constructed of the same or different materials as the pole 10. One having ordinary skill in the art will recognize that the materials for constructing the lock extension 1 are dictated by the necessity for strength, to lock the lock extension to a derail and to maintain proper verticality. Therefore, a steel construction is preferred, with parts adhered together preferably via welding.

A bulbous member 17 may also be provided adhered to said pole 10 at a location such that a terminal end 29 may be slidably disposed therein. The bulbous member 17 restricts upward movement of the pole sleeve 20 by stopping the terminal end 29 of the pole sleeve 20 when the pole sleeve 20 moves upwardly. As shown in FIG. 1, plate-like member 14 is preferably adhered, welded, or otherwise disposed on said bulbous member 17.

FIG. 2 illustrates an embodiment of the lock extension device 1 with said pole sleeve 20 disposed upwardly. The terminal end 29 of said pole sleeve 20 is disposed upwardly inside said bulbous member 17, thereby lifting said lock cover 21 away from horizontal member 12, allowing removal of said lock extension device from a derail, as described below.

To move said pole sleeve 20 upwardly, lock 25 must be removed, thereby allowing the flange 24 on the pole sleeve 20 to be raised with respect to said plate-like member 14, thereby misaligning aperture 24 of said flange and aperture 26 of said plate-like member 14.

FIGS. 3A and 3B illustrate a preferred method of using the herein-described lock extension device 1 and locking said lock extension device 1 to a derail. Specifically, FIGS. 3A and 3B illustrate a lower portion 30 of said lock extension device 1 shown with said horizontal member 12 locking a derail 32 to a base 34, thereby holding or locking said derail 32 onto a track 36. The derail 32 acts to cause a train to dislodge its wheels from said track 36 for protection of life and/or property.

Specifically, the horizontal member 12 engages a derail flange 38 having an aperture (not shown) therein. Moreover, the horizontal member 12 engages a further flange 40 on said base 34. Said flange 40 on said base 34 further has an aperture 42 therein, and said horizontal member 12 goes through both the flange 38 of the derail 32 and the flange 40 of the base 34 thereby locking the derail 32 to the base 34 and, by extension, locking said derail 32 to said rail 36. The lock cover 21 then slides over the horizontal member 12, and said horizontal member 12 goes through the aperture 22 in said lock cover 21. The lock cover 21 further engages the flanges 38, 40 and restricts movement of the horizontal member 12 through the flanges 38, 40 when locked with the locking device 13, as illustrated in FIG. 1.

Removal of the locking device requires removal of the lock such that the pole sleeve 20 may slide upwardly with respect to the pole 10, thereby lifting lock cover 21 and disengaging lock cover 21 from the horizontal member 12. The horizontal member 12 may then be removed from the flanges 38, 40 and the derail 32 may then be removed from the rail 36.

Figure 4:
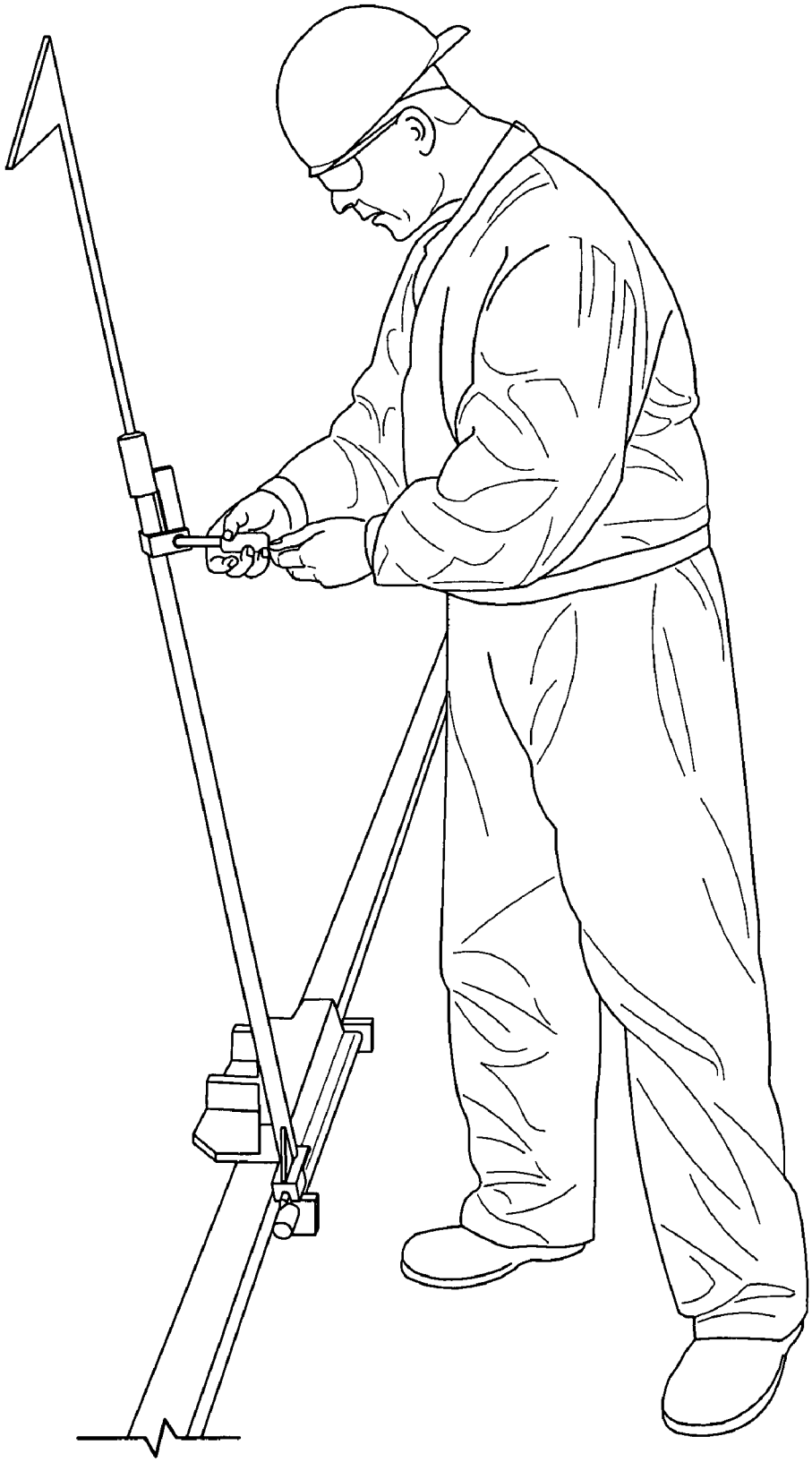
FIG. 4 is a perspective view of an individual using the lock extension device of the present invention in an upright position.
Figure 5:
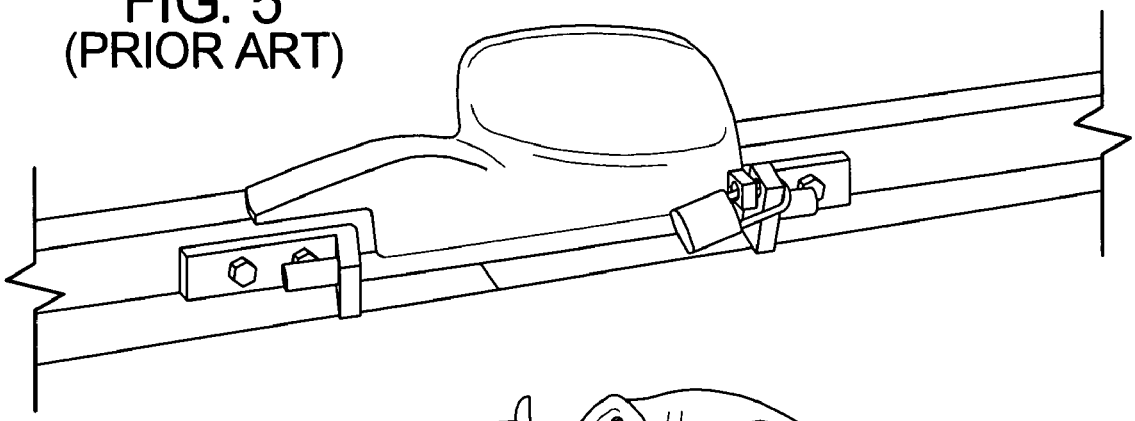
FIG. 5 (PRIOR ART)
FIG. 5 is a side view of a person bending to operate the prior art locking device.
Figure 6:
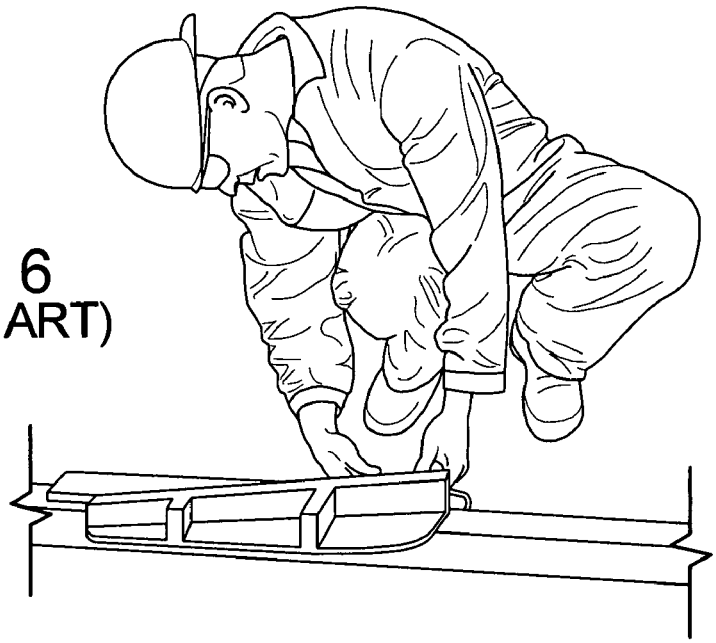
FIG. 6 (PRIOR ART)
FIG. 6 is a frontal view of a person twisting to operate the prior art locking device.
Figure 7:
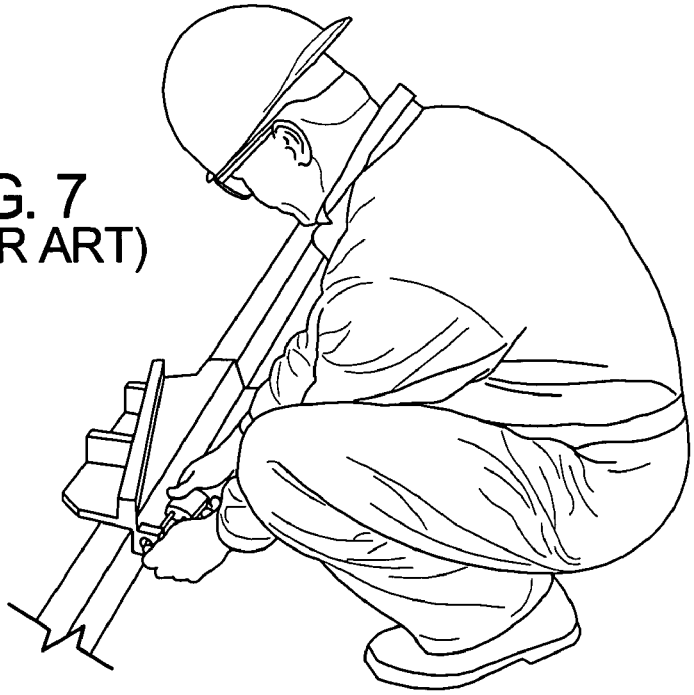
FIG. 7 (PRIOR ART)
FIG. 7 is a frontal view of the prior art locking device which is located at ground level.

FIG. 4 shows a person operating the locking device 13 of the lock extension device 1 of the present disclosure in a standing-upright position. As discussed herein, having the locking device 13 at a person's height allows the person to easily lock said derail to said track while standing, thereby diminishing bending and twisting of the person (as illustrated in FIGS. 5, 6 and 7) and protecting said person from injury.

The present disclosure has been described with reference to specific embodiments. However, one skilled in the art having read this disclosure will recognize that changes and modifications may be made to the specific embodiments disclosed herein without departing from the scope of the present disclosure.

What is claimed is:

1. A lock extension device for locking a train derail to a rail comprising:

a pole having a longitudinal member and a horizontal member and wherein said horizontal member of said pole can be mounted to said train derail;

a sleeve disposed over at least a portion of the longitudinal member of the pole, said sleeve comprising a cover, said cover comprising an aperture for engaging said horizontal member of said pole; and a locking device for holding said horizontal member in said aperture of said cover, said locking device further locking said pole to said sleeve.

2. The lock extension device according to claim 1 wherein said longitudinal member and said horizontal member of said pole are integrally formed.

3. The lock extension device according to claim 1 wherein both said longitudinal member and said horizontal member of said pole are cylindrical in shape.

4. The lock extension device according to claim 2 wherein said lock extension device is formed from steel.

5. The lock extension device according to claim 1 wherein the longitudinal member of said pole has a length from about 2 feet to about 6 feet.

6. The lock extension device according to claim 1 wherein said horizontal member is perpendicular to said longitudinal member.

7. The lock extension device according to claim 1 wherein said locking device comprises:

a base plate member disposed on said pole;

a flange disposed on said sleeve; and a lock holding said first base plate member to said flange.

8. The lock extension device of claim 7 wherein said base plate member is affixed to the outer longitudinal edge of the pole.

9. The lock extension device of claim 7 wherein said flange is affixed to the outer longitudinal edge of said pole.

10. The lock extension device of claim 7 wherein said base plate member comprises an aperture.

11. The lock extension device of claim 7 wherein said flange comprises an aperture.

12. The lock extension device according to claim 7 wherein said base plate member comprises a first aperture and said flange comprises a second aperture, wherein said lock is disposed through the first and second apertures.

13. The lock extension device according to claim 1 wherein said locking device is positioned at a height which allows a person to lock or unlock the locking device in a standing position.

14. The lock extension device according to claim 1 further comprising:

a bulbous member on said pole wherein said sleeve comprises an end, wherein said end is slidably disposed within said bulbous member.

15. The lock extension device according to claim 14 wherein the bulbous member restricts upward movement of the sleeve.

16. The lock extension device according to claim 14 wherein said bulbous member is formed with an opening at its bottom to receive the end of the sleeve.

17. The lock extension device according to claim 1 further comprising a signaling device disposed on an end of said pole.

18. The lock extension device according to claim 17 wherein said signaling device is a flag.

19. The lock extension device according to claim 1 further comprising:

a derail disposed on a rail and a base, said horizontal member disposed through both said derail and said base for holding the derail to said rail.

20. The lock extension device according to claim 19 wherein said derail comprises a first flange with a first aperture and said base comprises a second flange with a second aperture, said horizontal member disposed through the first aperture of said first flange and said second apertures of said second flange, said cover further disposed over said first and second flange and engaging said horizontal member, thereby holding said derail to said base.

* * * * *